US012006654B2

(12) United States Patent
Mura et al.

(10) Patent No.: US 12,006,654 B2
(45) Date of Patent: Jun. 11, 2024

(54) WORK MACHINE, SYSTEM INCLUDING WORK MACHINE, AND METHOD OF CONTROLLING WORK MACHINE

(71) Applicant: KOMATSU LTD., Tokyo (JP)

(72) Inventors: Atsushi Mura, Tokyo (JP); Haruki Nishiguchi, Tokyo (JP); Hayato Hisa, Tokyo (JP); Hiromu Dambayashi, Tokyo (JP); Akihiko Teramura, Tokyo (JP); Kazuki Takehara, Tokyo (JP); Katsuhiro Ikegami, Tokyo (JP)

(73) Assignee: KOMATSU LTD., Tokyo (JP)

( * ) Notice: Subject to any disclaimer, the term of this patent is extended or adjusted under 35 U.S.C. 154(b) by 550 days.

(21) Appl. No.: 17/288,944

(22) PCT Filed: Dec. 10, 2019

(86) PCT No.: PCT/JP2019/048198
§ 371 (c)(1),
(2) Date: Apr. 27, 2021

(87) PCT Pub. No.: WO2020/122044
PCT Pub. Date: Jun. 18, 2020

(65) Prior Publication Data

US 2021/0381195 A1 Dec. 9, 2021

(30) Foreign Application Priority Data

Dec. 13, 2018 (JP) ..... 2018-233489

(51) Int. Cl.
*E04B 1/32* (2006.01)
*E02F 3/43* (2006.01)
(Continued)

(52) U.S. Cl.
CPC ..... *E02F 3/437* (2013.01); *E02F 3/438* (2013.01); *E02F 9/2037* (2013.01);
(Continued)

(58) Field of Classification Search
CPC ..... E02F 3/437; E02F 9/2285; E02F 9/2253; E02F 9/2246; E02F 3/438; E02F 9/262;
(Continued)

(56) References Cited

U.S. PATENT DOCUMENTS 5,933,346 A 8/1999 Brabee et al.
6,836,982 B1 * 1/2005 Augustine ..... E02F 9/205 701/50

(Continued)

FOREIGN PATENT DOCUMENTS

CN 101815629 A 8/2010
CN 104060644 A 9/2014

(Continued)

OTHER PUBLICATIONS

Rylander et al., Using wireless communication to improve road safety and quality of service at road construction work sites (Poster), 2012, IEEE, p. 152-156 (Year: 2012).*

(Continued)

*Primary Examiner* — McDieunel Marc
(74) *Attorney, Agent, or Firm* — Faegre Drinker Biddle & Reath LLP

(57) ABSTRACT

A work machine capable of saving works by an operator during traveling is provided. The work machine includes a vehicular main body including a traveling unit, a work implement attached to the vehicular main body, and a controller that automatically controls operations by the work implement. The controller cancels automatic control of operations by the work implement based on a traveling state of the traveling unit.

6 Claims, 11 Drawing Sheets

(51) Int. Cl.
*E02F 9/20* (2006.01)
*E02F 9/22* (2006.01)
*E02F 9/26* (2006.01)

(52) U.S. Cl.
CPC ..... *E02F 9/2228* (2013.01); *E02F 9/2246* (2013.01); *E02F 9/2253* (2013.01); *E02F 9/262* (2013.01)

(58) Field of Classification Search
CPC ..... E02F 9/2037; E02F 9/2228; B28B 1/001; B28B 3/2636; B28B 3/20; B28B 17/0081; B28B 3/2645; E04G 11/20; E04G 21/0463; E04G 21/04; B33Y 10/00; B33Y 70/00; B33Y 50/02; B33Y 30/00; B33Y 80/00; C04B 28/02; C04B 2111/00181; E04B 1/3505; E04B 1/16; E04B 2103/02; E04B 1/32; E04B 1/166
See application file for complete search history.

(56) References Cited

U.S. PATENT DOCUMENTS

| | | | | |
|---|---|---|---|---|
| 9,611,620 | B2 * | 4/2017 | Paull | E02F 3/433 |
| 9,670,641 | B2 * | 6/2017 | Paull | E02F 3/3417 |
| 9,903,100 | B2 * | 2/2018 | Fletcher | E02F 9/265 |
| 10,486,330 | B2 * | 11/2019 | Giles | B28B 3/20 |
| 10,688,683 | B2 * | 6/2020 | Giles | E04G 11/20 |
| 2003/0115779 | A1 * | 6/2003 | Satzler | E02F 3/439 37/348 |
| 2003/0132729 | A1 * | 7/2003 | Yoshimatsu | F15B 11/165 320/104 |
| 2003/0152452 | A1 * | 8/2003 | Hodgson | G05G 9/047 414/694 |
| 2007/0227137 | A1 | 10/2007 | Naruse | |
| 2008/0097672 | A1 * | 4/2008 | Clark | E02F 3/437 701/50 |
| 2009/0031891 | A1 * | 2/2009 | Brinkman | E02F 9/2228 60/327 |
| 2010/0274436 | A1 | 10/2010 | Kodaka et al. | |
| 2010/0299031 | A1 | 11/2010 | Zhdanov et al. | |
| 2015/0308081 | A1 | 10/2015 | Takaura et al. | |
| 2016/0040391 | A1 | 2/2016 | Imaizumi et al. | |
| 2017/0114525 | A1 | 4/2017 | Rosa Neto | |
| 2017/0183845 | A1 | 6/2017 | Izumikawa | |
| 2018/0051445 | A1 | 2/2018 | Hori et al. | |
| 2019/0390443 | A1 | 12/2019 | Yamamoto et al. | |

FOREIGN PATENT DOCUMENTS

| | | | |
|---|---|---|---|
| CN | 104471152 | A | 3/2015 |
| CN | 106715803 | A | 5/2017 |
| CN | 107208405 | A | 9/2017 |
| JP | H10-088623 | A | 4/1998 |
| JP | 2001-032331 | A | 2/2001 |
| JP | 2001-098585 | A | 4/2001 |
| JP | 5706050 | B1 | 4/2015 |
| JP | 2017-008719 | A | 1/2017 |
| JP | 2017-082576 | A | 5/2017 |
| JP | 2018-102220 | A | 7/2018 |
| JP | 6373728 | B2 | 8/2018 |
| JP | 2018-145684 | A | 9/2018 |
| WO | WO-2005/108797 | A1 | 11/2005 |
| WO | WO-2015/004809 | A1 | 1/2015 |
| WO | WO-2016/043270 | A1 | 3/2016 |
| WO | WO-2018/198761 | A1 | 11/2018 |

OTHER PUBLICATIONS

Nevala et al., Developing of the anti-slip control of hydrostatic power transmission for forest tractor and optimisation of the power of diesel engine, 1998, IEEE, p. 475-480 (Year: 1998).*
Cormier et al., On the steering of automated vehicles—A velocity-adaptive controller, 1980, IEEE, p. 375-385 (Year: 1980).*
Bender et al., An experimental study of vehicle automatic longitudinal control, 1971, IEEE, p. 114-123 (Year: 1971).*
Hajdu et al., Design and control considerations for automated ground transportation systems, 1968, IEEE, p. 493-513 (Year: 1968).*
Lourenço et al., A Hybrid V21 and V2V Approach for Urban Traffic Management in Vehicular Networks, 2019, IEEE, p. 1-6 (Year: 2019).*
Hongo et al., An Automatic Guidance System of a Self-Controlled Vehicle, 1987, IEEE, p. 5-10 (Year: 1987).*
Lezniak et al., A dead reckoning/map correlation system for automatic vehicle tracking, 1977, IEEE, p. 47-60 (Year: 1977).*

* cited by examiner

WORK MACHINE, SYSTEM INCLUDING WORK MACHINE, AND METHOD OF CONTROLLING WORK MACHINE

TECHNICAL FIELD

The present disclosure relates to a work machine, a system including a work machine, and a method of controlling a work machine.

BACKGROUND ART

In connection with a work machine, Japanese Patent Laying-Open No. 2017-008719 (PTL 1) discloses a system for controlling excavation by a hydraulic excavator, the system indicating cancellation of excavation restriction control when a boom is lowered while the hydraulic excavator is revolved.

CITATION LIST

Patent Literature

PTL 1: Japanese Patent Laying-Open No. 2017-008719

SUMMARY OF INVENTION

Technical Problem

For canceling automatic control in a work machine with a function of automatic control of operations by a work implement, an operator has conventionally had to perform a cancellation operation except for a case as above. During traveling, automatic control of operations by the work implement is not necessary, and hence the operator has had to perform the cancellation operation each time.

The present disclosure provides a work machine, a system including a work machine, and a method of controlling a work machine that are capable of saving works by an operator during traveling.

Solution to Problem

According to the present disclosure, a work machine including a vehicular main body including a traveling unit, a work implement attached to the vehicular main body, and a controller that automatically controls operations by the work implement is provided. The controller cancels automatic control of operations by the work implement based on a traveling state of the traveling unit.

Advantageous Effects of Invention

According to the present disclosure, works by an operator during traveling of a work machine can be saved.

DESCRIPTION OF EMBODIMENTS

Figure 1:
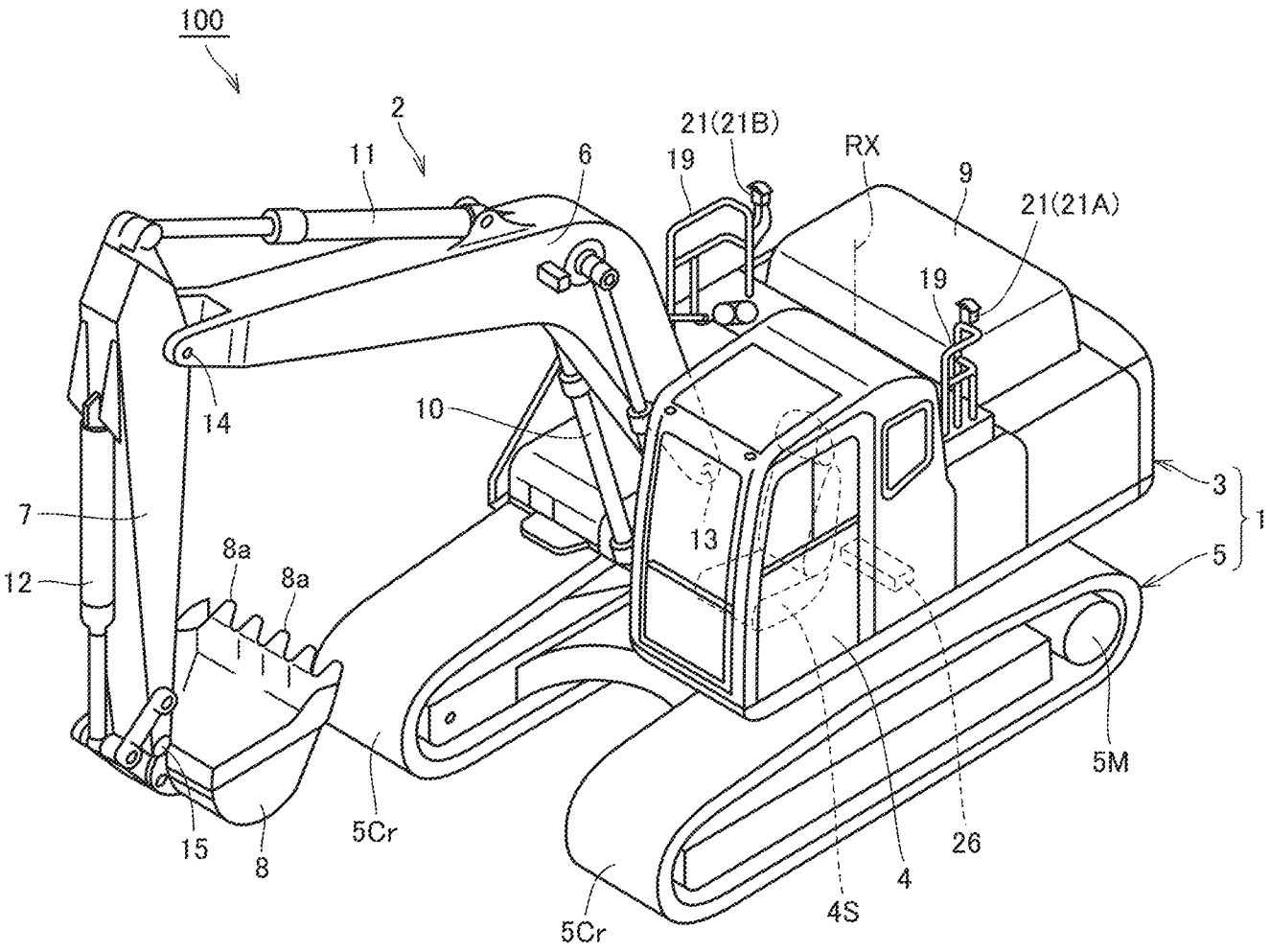
FIG. 1 is a diagram of appearance of a hydraulic excavator based on an embodiment.

An embodiment will be described hereinafter with reference to the drawings. In the description below, the same elements have the same reference characters allotted and their labels and functions are also the same. Therefore, detailed description thereof will not be repeated.

First Embodiment

FIG. 1 is a diagram of appearance of a hydraulic excavator 100 based on an embodiment. As shown in FIG. 1, in the present example, hydraulic excavator 100 will mainly be described by way of example as a work machine.

Hydraulic excavator 100 includes a main body 1 and a hydraulically operated work implement 2. Main body 1 includes a revolving unit 3 and a traveling unit 5. Traveling unit 5 includes a pair of crawler belts 5C*r* and a travel motor 5M. Hydraulic excavator 100 can travel as crawler belts 5C*r* rotate. Travel motor 5M is provided as a drive source for traveling unit 5. Travel motor 5M is a hydraulically operated hydraulic motor. Traveling unit 5 may include wheels (tires).

Revolving unit 3 is arranged on traveling unit 5 and supported by traveling unit 5. Revolving unit 3 can revolve with respect to traveling unit 5, around an axis of revolution RX. Revolving unit 3 includes a cab 4. A driver (operator) of hydraulic excavator 100 rides on cab 4 and steers hydraulic excavator 100. Cab 4 is provided with an operator's seat 4S where an operator sits. The operator can operate hydraulic excavator 100 in cab 4. The operator can operate work implement 2, can perform an operation to revolve revolving unit 3 with respect to traveling unit 5, and can perform an operation to travel hydraulic excavator 100 by means of traveling unit 5.

Revolving unit 3 includes an engine compartment 9 accommodating an engine and a counterweight provided in a rear portion of revolving unit 3. In engine compartment 9, an engine 31 and a hydraulic pump 33 which will be described later are arranged.

In revolving unit 3, a handrail 19 is provided in front of engine compartment 9. An antenna 21 is provided in handrail 19. Antenna 21 is, for example, an antenna for global navigation satellite systems (GNSS). Antenna 21 includes a first antenna 21A and a second antenna 21B provided in revolving unit 3 as being distant from each other in a direction of a width of a vehicle.

Work implement 2 is supported by revolving unit 3. Work implement 2 includes a boom 6, an arm 7, and a bucket 8. Boom 6 is pivotably coupled to revolving unit 3. Arm 7 is pivotably coupled to boom 6. Bucket 8 is pivotably coupled to arm 7. Bucket 8 includes a plurality of blades. A tip end of bucket 8 is referred to as a cutting edge 8*a*.

Bucket 8 does not have to include a blade. The tip end of bucket 8 may be formed from a steel plate in a straight shape.

A base end of boom 6 is coupled to revolving unit 3 with a boom pin 13 being interposed. A base end of arm 7 is coupled to a tip end of boom 6 with an arm pin 14 being interposed. Bucket 8 is coupled to a tip end of arm 7 with a bucket pin 15 being interposed.

In the present embodiment, positional relation among components of hydraulic excavator 100 will be described with work implement 2 being defined as the reference.

Boom 6 of work implement 2 pivots with respect to revolving unit 3, around boom pin 13 provided at the base end of boom 6. Movement of a specific portion of boom 6 which pivots with respect to revolving unit 3, for example, the tip end of boom 6, leaves a trace in an arc shape, and a plane including the arc is specified. When hydraulic excavator 100 is planarly viewed, the plane is represented as a straight line. A direction of extension of this straight line is defined as a fore/aft direction of main body 1 of hydraulic excavator 100 or revolving unit 3, and it is hereinafter also simply referred to as the fore/aft direction. A lateral direction (a direction of a vehicle width) of main body 1 of hydraulic excavator 100 or a lateral direction of revolving unit 3 is orthogonal to the fore/aft direction in a plan view, and it is hereinafter also simply referred to as the lateral direction. An upward/downward direction of the vehicular main body or an upward/downward direction of revolving unit 3 refers to a direction orthogonal to the plane defined by the fore/aft direction and the lateral direction, and it is also simply referred to as the upward/downward direction below.

A side where work implement 2 protrudes from main body 1 of hydraulic excavator 100 in the fore/aft direction is the fore direction and a direction opposite to the fore direction is the aft direction. A right side and a left side of the lateral direction when one faces front are the right direction and the left direction, respectively. A side in the upward/downward direction where the ground is located is defined as a lower side and a side where the sky is located is defined as an upper side.

The fore/aft direction refers to a fore/aft direction of an operator who sits at operator's seat 4S in cab 4. A direction in which the operator sitting at operator's seat 4S faces is defined as the fore direction and a direction behind the operator who sits at operator's seat 4S is defined as the aft direction. The lateral direction refers to a lateral direction of the operator who sits at operator's seat 4S. A right side and a left side at the time when the operator sitting at operator's seat 4S faces front are defined as the right direction and the left direction, respectively. The upward/downward direction refers to the upward/downward direction of the operator who sits at operator's seat 4S. A foot side of the operator who sits at operator's seat 4S is referred to as the lower side and a head side is referred to as the upper side.

Boom 6 can pivot around boom pin 13. Arm 7 can pivot around arm pin 14. Bucket 8 can pivot around bucket pin 15. Each of arm 7 and bucket 8 is a movable member movable on a tip end side of boom 6. Boom pin 13, arm pin 14, and bucket pin 15 extend in the lateral direction.

Work implement 2 includes a boom cylinder 10, an arm cylinder 11, and a bucket cylinder 12. Boom cylinder 10 drives boom 6. Arm cylinder 11 drives arm 7. Bucket cylinder 12 drives bucket 8. Each of boom cylinder 10, arm cylinder 11, and bucket cylinder 12 is implemented by a hydraulic cylinder driven with hydraulic oil.

Bucket cylinder 12 is attached to arm 7. As bucket cylinder 12 extends and contracts, bucket 8 pivots with respect to arm 7. Work implement 2 includes a bucket link. The bucket link couples bucket cylinder 12 and bucket 8 to each other.

A controller 26 is mounted on hydraulic excavator 100. Details of controller 26 will be described later.

Figure 2:
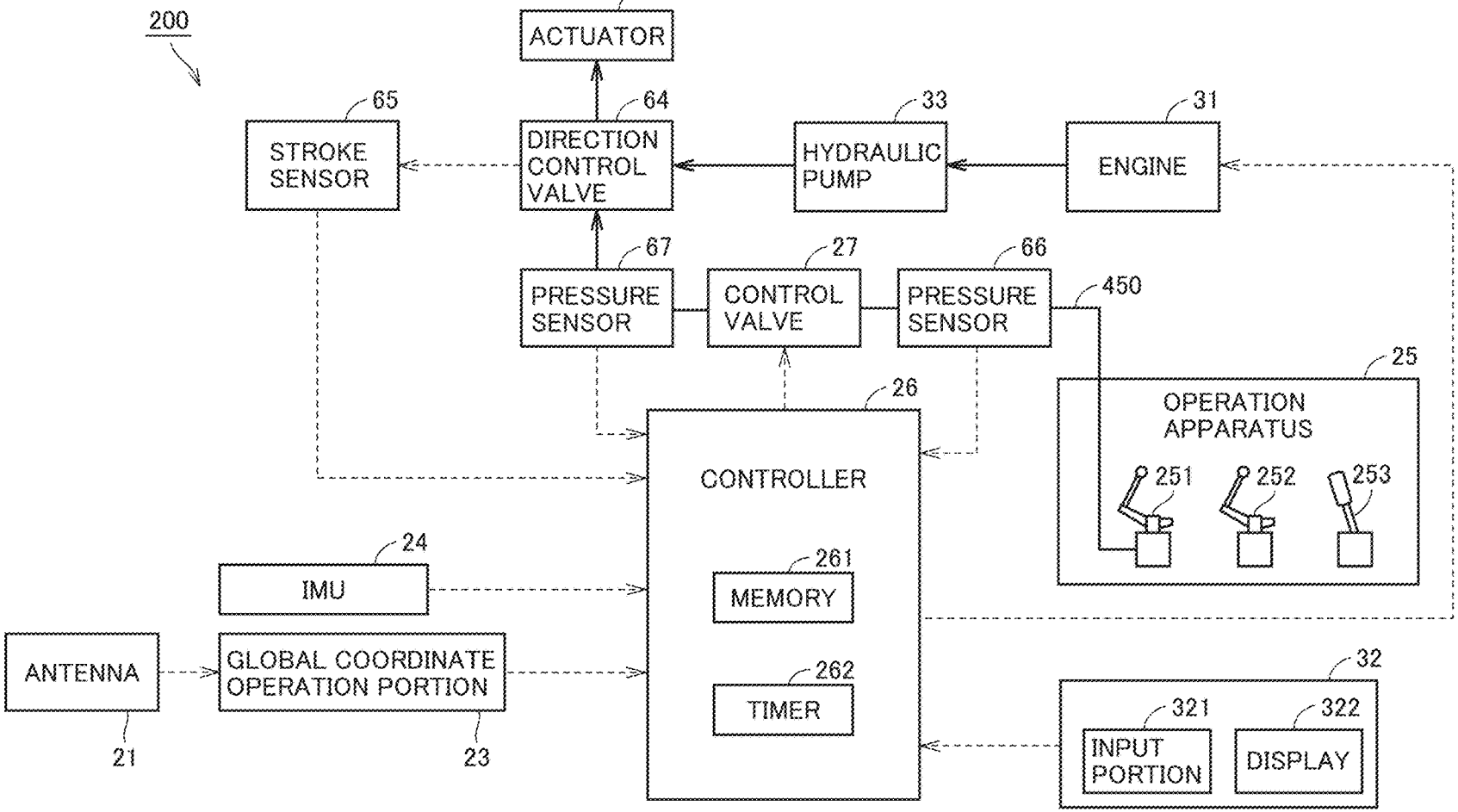
FIG. 2 is a block diagram showing a system configuration of the hydraulic excavator based on the embodiment.

FIG. 2 is a block diagram showing a system configuration of hydraulic excavator 100 based on the embodiment. As shown in FIG. 2, a control system 200 is mounted on hydraulic excavator 100.

Control system 200 includes antenna 21, a global coordinate operation portion 23, an inertial measurement unit (IMU) 24, an operation apparatus 25, controller 26, a pressure sensor 66 and a pressure sensor 67, a control valve 27, a direction control valve 64, and a man-machine interface portion 32.

Controller 26 includes a memory 261. Memory 261 stores a program for controlling various operations by hydraulic excavator 100. Controller 26 performs various types of processing for controlling operations by hydraulic excavator 100 based on the program stored in memory 261. Memory 261 is a non-volatile memory and provided as an area for storing necessary data. Controller 26 includes a timer 262 for counting prescribed time.

Antenna 21 provides a signal in accordance with received radio waves (GNSS radio waves) to global coordinate operation portion 23. Global coordinate operation portion 23 detects a position of installation of antenna 21 on a global coordinate system. The global coordinate system is a three-dimensional coordinate system based on a reference position set in a work area. The reference position may be a position of a tip end of a reference marker set in the work area.

IMU 24 is provided in revolving unit 3. In the present example, IMU 24 is arranged in a lower portion of cab 4. In revolving unit 3, a highly rigid frame is arranged in the lower portion of cab 4. IMU 24 is arranged on that frame. IMU 24 may be arranged lateral to (on the right or left of) axis of revolution RX of revolving unit 3. IMU 24 measures an acceleration of revolving unit 3 in the fore/aft direction, the lateral direction, and the upward/downward direction and an angular velocity of revolving unit 3 around the fore/aft direction, the lateral direction, and the upward/downward direction.

Operation apparatus 25 is arranged in cab 4. The operator operates operation apparatus 25. Operation apparatus 25 accepts an operation by the operator to travel hydraulic excavator 100 (traveling unit 5). Operation apparatus 25 accepts an operation by the operator for driving work implement 2. Operation apparatus 25 provides an operation signal in accordance with an operation by the operator. In the present example, operation apparatus 25 is an operation apparatus of a pilot hydraulic type.

Control system 200 is configured such that hydraulic oil delivered from hydraulic pump 33 as a result of drive of hydraulic pump 33 by engine 31 is supplied to various hydraulic actuators 60 through direction control valve 64 in correspondence with an operation onto operation apparatus 25 by the operator. As application and release of a hydraulic pressure to and from hydraulic actuator 60 is controlled, an operation by work implement 2, revolution of revolving unit 3, and a traveling operation by traveling unit 5 are controlled. Hydraulic actuator 60 includes boom cylinder 10, arm cylinder 11, bucket cylinder 12, and travel motor 5M shown in FIG. 1 and a not-shown revolution motor.

Engine 31 is a diesel engine. As controller 26 controls an amount of fuel injected into engine 31, output from engine 31 is controlled.

Hydraulic pump 33 is coupled to engine 31. As rotational driving force of engine 31 is transmitted to hydraulic pump 33, hydraulic pump 33 is driven.

Hydraulic pump 33 is a variable displacement hydraulic pump which includes a swash plate and varies a discharge volume with variation in tilting angle of the swash plate. Hydraulic oil delivered from hydraulic pump 33 is reduced in pressure to a certain pressure through a pressure reduction valve and supplied to direction control valve 64.

Direction control valve 64 is a spool valve that switches a direction of flow of hydraulic oil by movement of a rod-like spool. As the spool axially moves, an amount of supply of hydraulic oil to hydraulic actuator 60 is regulated. Direction control valve 64 is provided with a spool stroke sensor 65 that detects a stroke of the spool (spool stroke). A detection signal from spool stroke sensor 65 is provided to controller 26.

In the present example, oil supplied to hydraulic actuator 60 in order to activate hydraulic actuator 60 is referred to as hydraulic oil. Oil supplied to direction control valve 64 for activating direction control valve 64 is referred to as pilot oil. A pressure of the pilot oil is also referred to as a pilot oil pressure.

Hydraulic oil and pilot oil may be delivered from the same hydraulic pump. For example, a pressure of some of hydraulic oil delivered from hydraulic pump 33 may be reduced by a pressure reduction valve and hydraulic oil, a pressure of which has been reduced, may be used as pilot oil. Separately from hydraulic pump 33 that delivers hydraulic oil (a main hydraulic pump), a hydraulic pump that delivers pilot oil (a pilot hydraulic pump) may be provided.

Operation apparatus 25 includes a first travel control lever 251, a second travel control lever 252, and a work implement lever 253. First travel control lever 251 and second travel control lever 252 are arranged, for example, in front of operator's seat 4S. Work implement lever 253 is arranged, for example, laterally to operator's seat 4S.

A pair of travel control levers 251 and 252 are members operated by an operator for controlling travel of hydraulic excavator 100 (traveling unit 5). Work implement lever 253 is a member operated by the operator for controlling operations by work implement 2, that is, boom 6, arm 7, and bucket 8.

Pilot oil delivered from the hydraulic pump, a pressure of which has been reduced by the pressure reduction valve, is supplied to operation apparatus 25. The pilot oil pressure is regulated based on an amount of operation of operation apparatus 25.

Operation apparatus 25 and direction control valve 64 are connected to each other through a pilot oil path 450. Pilot oil is supplied to direction control valve 64 through pilot oil path 450. Control valve 27, pressure sensor 66, and pressure sensor 67 are arranged in pilot oil path 450.

Control valve 27 regulates a pilot oil pressure based on a control signal (an EPC current) from controller 26. Control valve 27 is an electromagnetic proportional control valve and is controlled based on a control signal from controller 26. Control valve 27 regulates a pilot oil pressure of pilot oil supplied to each of a pair of pressure reception chambers of direction control valve 64, so as to be able to regulate an amount of supply of hydraulic oil supplied to hydraulic actuator 60 through direction control valve 64.

Pressure sensor 66 and pressure sensor 67 detect the pilot oil pressure. Pressure sensor 66 is arranged in pilot oil path 450 between operation apparatus 25 and control valve 27. Pressure sensor 66 detects a pilot oil pressure before regulation by control valve 27. Pressure sensor 67 is arranged in pilot oil path 450 between control valve 27 and direction control valve 64. Pressure sensor 67 detects a pilot oil pressure regulated by control valve 27. Results of detection by pressure sensor 66 and pressure sensor 67 are provided to controller 26.

As first travel control lever 251 is operated, a pilot oil pressure corresponding to an amount of operation is supplied to direction control valve 64. Direction control valve 64 regulates a direction of flow and a flow rate of hydraulic oil supplied to right travel motor 5M. Supply of hydraulic oil to right travel motor 5M is thus controlled to control output from a right traveling apparatus.

As second travel control lever 252 is operated, a pilot oil pressure corresponding to an amount of operation is supplied to direction control valve 64. Direction control valve 64 regulates a direction of flow and a flow rate of hydraulic oil supplied to left travel motor 5M. Supply of hydraulic oil to left travel motor 5M is thus controlled to control output from a left traveling apparatus.

The direction of rotation of right travel motor 5M is switched in accordance with the direction of operation of first travel control lever 251. The direction of rotation of left travel motor 5M is switched in accordance with the direction of operation of second travel control lever 252. Hydraulic excavator 100 can move forward or rearward by rotation of left and right travel motors 5M in the same direction, and hydraulic excavator 100 can make a spin turn by rotation of left and right travel motors 5M in directions reverse to each other.

As set forth above, the operator can control a traveling operation of hydraulic excavator 100 by operating first travel control lever 251 and second travel control lever 252.

As work implement lever 253 is operated, a pilot oil pressure corresponding to such operation contents is supplied to direction control valve 64. A direction of flow and a flow rate of hydraulic oil supplied to boom cylinder 10, arm cylinder 11, bucket cylinder 12, and the revolution motor are thus regulated to control operations by work implement 2 and a revolving operation by revolving unit 3.

Man-machine interface portion 32 includes an input portion 321 and a display (a monitor) 322. In the present example, input portion 321 includes an operation button arranged around display 322. Input portion 321 may include a touch panel. Man-machine interface portion 32 is also referred to as a multi-monitor.

Input portion 321 is operated by an operator. A command signal generated in response to an operation onto input portion 321 is provided to controller 26. Display 322 displays an amount of remaining fuel and a coolant temperature as basic information.

Figure 3:
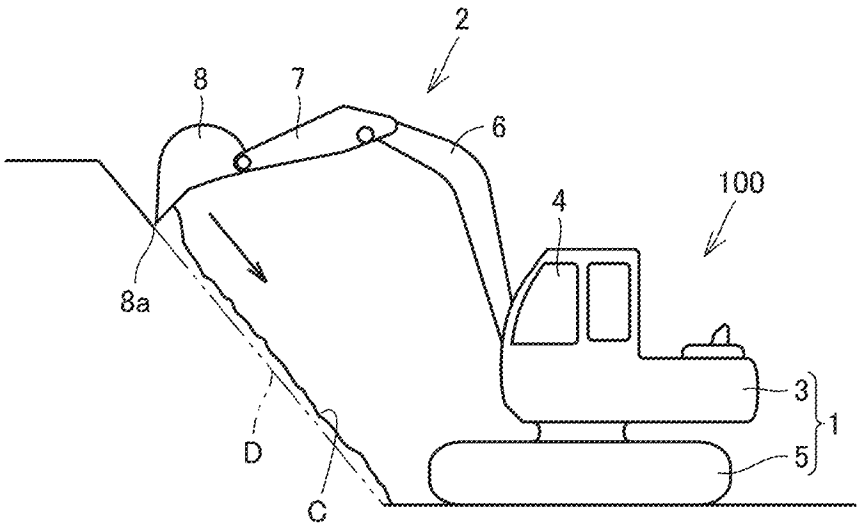
FIG. 3 is a schematic side view showing control of land grading by the hydraulic excavator.

Automatic control of work implement 2 in land grading works by hydraulic excavator 100 constructed above will be described below. FIG. 3 is a schematic side view showing control of land grading by hydraulic excavator 100. FIG. 3 shows hydraulic excavator 100, current topography C which is an object to be worked by work implement 2, and design topography D. Design topography D is a target shape of the object to be worked by work implement 2 in accordance with execution design data stored in advance in memory 261 of controller 26. Design topography D shown in FIG. 3 is a slope. Design topography D shown in FIG. 3 is flat.

Control system 200 controls operations by work implement 2 for design topography D. Control system 200 controls processing for excavation by work implement 2. In the present example, control for processing for excavation includes land grading control. Land grading control means automatic control of land grading works to plow and level soil that comes in contact with bucket 8 as a result of movement of bucket 8 along the design topography and to make a plane in conformity with the design topography, and it is also referred to as restricted excavation control.

Land grading control is carried out when the operator operates arm 7 and when a distance between cutting edge 8*a* of bucket 8 and design topography D and a speed of cutting edge 8*a* are each within a reference range. Controller 26 carries out land grading control based on execution design data and information on a current position of work implement 2.

The operator who operates work implement 2 performs an operation to draw up arm 7 toward main body 1. In an example where design topography D has a flat surface, when work implement 2 is operated in accordance with an operation by the operator, cutting edge 8*a* of bucket 8 may move below design topography D and dig too much, because cutting edge 8*a* of bucket 8 moves as exhibiting a trace in an arc shape. In this case, controller 26 provides a command to forcibly raise boom 6. When cutting edge 8*a* of bucket 8 is likely to move below design topography D, controller 26 controls boom 6 to automatically move upward such that cutting edge 8*a* of bucket 8 does not move below design topography D.

As shown with an arrow in FIG. 3, by operating work implement 2 such that cutting edge 8*a* of bucket 8 moves along design topography D, cutting edge 8*a* of bucket 8 levels current topography C of the slope so that land grading in conformity with design topography D is carried out.

Control of processing for excavation by work implement 2 may include, other than land grading control described above, stop control to automatically stop operations by work implement 2 at a position where work implement 2 (for example, a part of bucket 8 such as cutting edge 8*a*) comes in contact with design topography D. Automatic control of work implement 2 may be semiautomatic control carried out in combination with a manual operation by the operator as described above. Alternatively, automatic control of work implement 2 may be fully automatic control without any manual operation by the operator.

Figure 4:
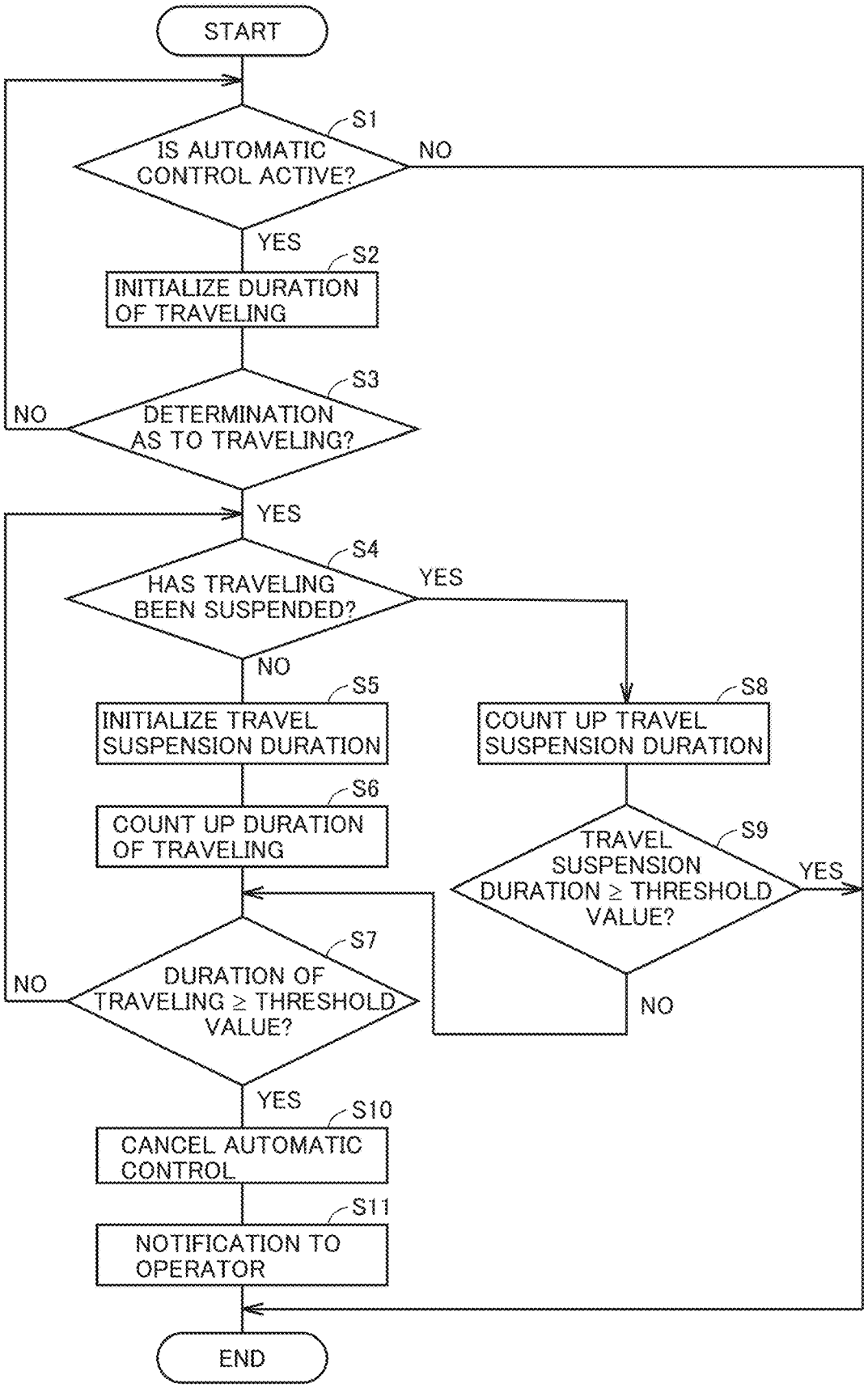
FIG. 4 is a flowchart showing processing for canceling automatic control.

Control for canceling automatic control of operations by work implement 2 based on a traveling state of traveling unit 5 will now be described. FIG. 4 is a flowchart showing processing for canceling automatic control.

As shown in FIG. 4, in step S1, whether or not automatic control of operations by work implement 2 is active is determined. Automatic control of operations by work implement 2 is activated by an operation by the operator. The operator can activate automatic control of operations by work implement 2 by operating input portion 321 of man machine interface portion 32 shown in FIG. 2, or can inactivate automatic control so as to manually operate work implement 2.

An operation onto input portion 321 by the operator is provided from man machine interface portion 32 to controller 26. Controller 26 determines whether or not automatic control of operations by work implement 2 is active based on the operation onto input portion 321 by the operator.

When automatic control of work implement 2 is determined as being active (YES in step S1), then in step S2, a duration of traveling is initialized. Controller 26 sets a duration T1 during which traveling unit 5 has continued traveling. Controller 26 reads current time from timer 262 and sets T1=0 at that read time. Controller 26 has memory 261 record the time at which T1=0 is set.

Then in step S3, determination as to traveling is made. Controller 26 determines whether or not traveling unit 5 is in a traveling state based on a result of detection of a pilot oil pressure by pressure sensor 66 between first travel control lever 251 and direction control valve 64 and pressure sensor 66 between second travel control lever 252 and direction control valve 64. More specifically, when pressure sensor 66 detects a pilot oil pressure equal to or higher than a prescribed threshold value, it is determined that the operator has operated one or both of first travel control lever 251 and second travel control lever 252 and an operation to run traveling unit 5 is being performed.

The traveling state herein refers to a state that the operator is performing an operation to run traveling unit 5 (hydraulic excavator 100). A state that at least any one of first travel control lever 251 and second travel control lever 252 has been moved from a neutral position as a result of the operation by the operator and set at a position other than the neutral position is defined as the traveling state. A state that both of first travel control lever 251 and second travel control lever 252 are set at the neutral position does not fall under the traveling state.

There is some time lag from the operation of the travel control lever by the operator while traveling unit 5 remains stopped until occurrence of a flow of hydraulic oil and actual start of traveling of traveling unit 5. One should note that the traveling state does not refer to a state that traveling unit 5 is actually traveling but may encompass a case in which traveling unit 5 is not actually traveling although it is in the traveling state.

When traveling unit 5 is determined as not being in the traveling state in determination in step S3 (NO in step S3), the process returns to determination in step S1.

When traveling unit 5 is determined as being in the traveling state in determination in step S3 (YES in step S3), the process proceeds to step S4 and whether or not traveling of traveling unit 5 has suspended is determined. Controller 26 determines whether or not an operation to run traveling unit 5 by the operator has suspended based on a result of detection of the pilot oil pressure by pressure sensor 66 described above. When the pilot oil pressure is lower than the prescribed threshold value, it means that both of first travel control lever 251 and second travel control lever 252 are located at the neutral position and the operator is operating neither of first travel control lever 251 and second travel control lever 252. Controller 26 determines a state that the pilot oil pressure detected by pressure sensor 66 is lower than the prescribed threshold value as suspension of traveling.

When traveling of traveling unit 5 is determined as not having suspended (NO in step S4), the process proceeds to step S5 and a travel suspension duration is initialized. Controller 26 sets a duration T2 during which traveling of traveling unit 5 has suspended. When traveling unit 5 is determined as being in the traveling state in step S3 and when traveling of traveling unit 5 is determined as not having suspended in step S4, it means that traveling unit 5 is continuing the traveling state. In this case, controller 26 reads current time from timer 262 and sets T2=0 at that read time. Controller 26 has memory 261 record time at which T2=0 is set.

Then in step S6, the duration of traveling is counted up. Controller 26 reads current time from timer 262. Controller 26 adds to duration T1, a time period from the time at which T1=0 was set in step S2 until the time read from timer 262 in step S6 to update duration T1.

Then in step S7, whether or not the duration of traveling is equal to or longer than a threshold value is determined. Controller 26 reads from memory 261, the threshold value for the duration during which traveling of traveling unit 5 has continued.

Controller 26 compares duration T1 updated in step S6 with the threshold value for the duration of traveling and determines whether or not duration T1 is equal to or longer than the threshold value for the duration of traveling. Controller 26 determines whether or not traveling of traveling unit 5 has continued for a prescribed time period.

The threshold value for duration T1 during which traveling unit 5 has continued traveling may be, for example, not smaller than two minutes and not larger than five minutes.

When duration T1 during which traveling unit 5 has continued traveling is shorter than the threshold value in determination in step S7 (NO in step S7), the process returns to step S4 and whether or not traveling of traveling unit 5 has suspended is determined again.

When traveling of traveling unit 5 is determined as having suspended in determination in step S4 (YES in step S4), the process proceeds to step S8 and the travel suspension duration is counted up. Controller 26 reads current time from timer 262. Duration T2 was initialized in step S5. Controller 26 adds to duration T2, a time period from the time at which T2=0 was set in step S5 until the time read from timer 262 in step S8 to update duration T2.

Then in step S9, whether or not the travel suspension duration is equal to or longer than the threshold value is determined. Controller 26 reads from memory 261, the threshold value for the duration during which traveling of traveling unit 5 has suspended. Controller 26 compares duration T2 updated in step S8 with the threshold value for the travel suspension duration and determines whether or not duration T2 is equal to or longer than the threshold value for the travel suspension duration. Controller 26 determines whether or not suspension of traveling of traveling unit 5 has continued for a prescribed time period.

The threshold value for duration T2 during which traveling of traveling unit 5 has suspended may be, for example, not smaller than 0.1 second and not larger than one second.

When duration T2 during which traveling of traveling unit 5 has suspended is determined as being shorter than the threshold value (NO in step S9), the process proceeds to step S7, where whether or not the duration of traveling is equal to or longer than the threshold value is determined.

In processing for counting up the duration of traveling in step S6 for the second time or later, a time period from the time read from timer 262 in the previous processing in step S6 until the time read from timer 262 in the present processing in step S6 is added to duration T1 to update duration T1.

When traveling of traveling unit 5 is determined as having suspended consecutively two or more times in determination in step S4, in the processing for counting up the travel suspension duration in step S8 for the second time or later, a time period from the time read from timer 262 in the previous processing in step S8 until the time read from timer 262 in the present processing in step S8 is added to duration T2 to update duration T2.

When traveling of traveling unit 5 is determined as having suspended in determination in step S4 and the travel suspension duration is determined as being shorter than the threshold value in determination in step S9 and thereafter traveling of traveling unit 5 is determined as not having suspended (traveling unit 5 is determined as traveling) in determination in next step S4, the travel suspension duration is initialized in step S5 as described above. When traveling of traveling unit 5 suspends and the duration of suspension of traveling (duration T2) is shorter than the threshold value, controller 26 determines that traveling unit 5 continues traveling.

When duration T1 during which traveling unit 5 has continued traveling is equal to or longer than the threshold value in determination in step S7 (YES in step S7), the process proceeds to step S10 and controller 26 cancels automatic control of work implement 2. Automatic control of work implement 2 is thus automatically inactivated and work implement 2 is driven in a manual mode. In this case, even though a command to operate arm 7 is detected while cutting edge 8*a* of bucket 8 is located below design topography D, a command signal to forcibly raise boom 6 is not provided.

In succession, in step S11, the operator is notified of cancellation of automatic control of operations by work implement 2.

Figure 5:
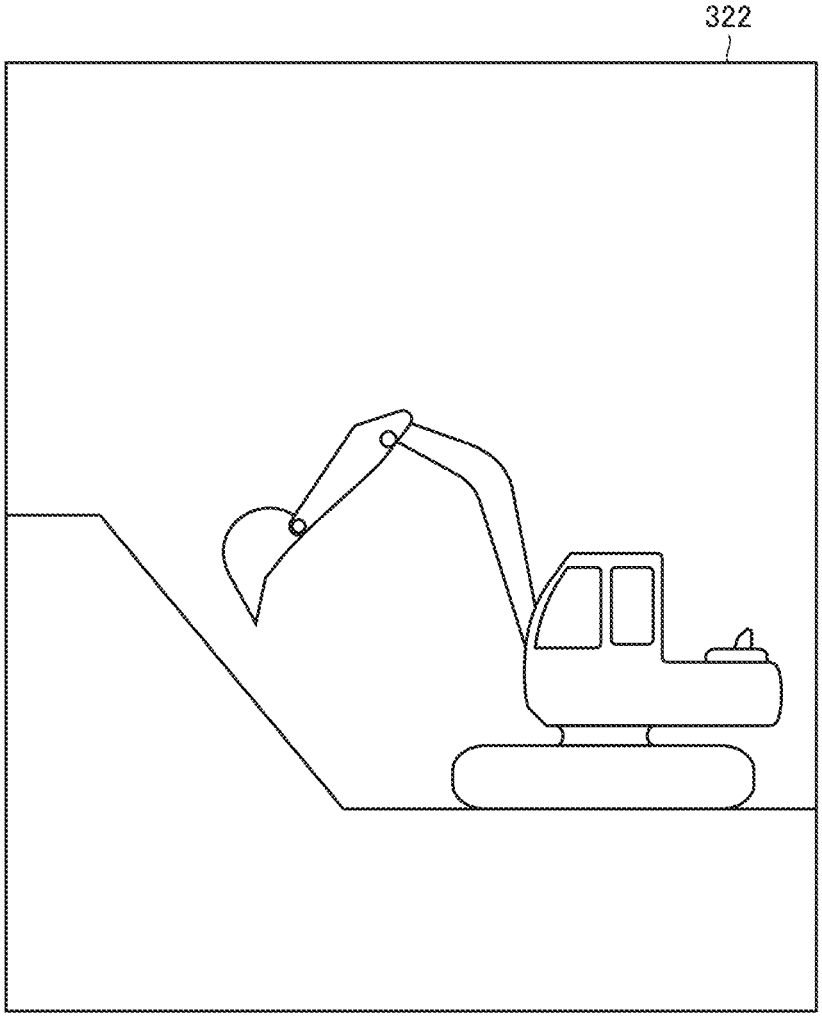
FIG. 5 is a schematic diagram showing an exemplary image shown on a display.
Figure 6:
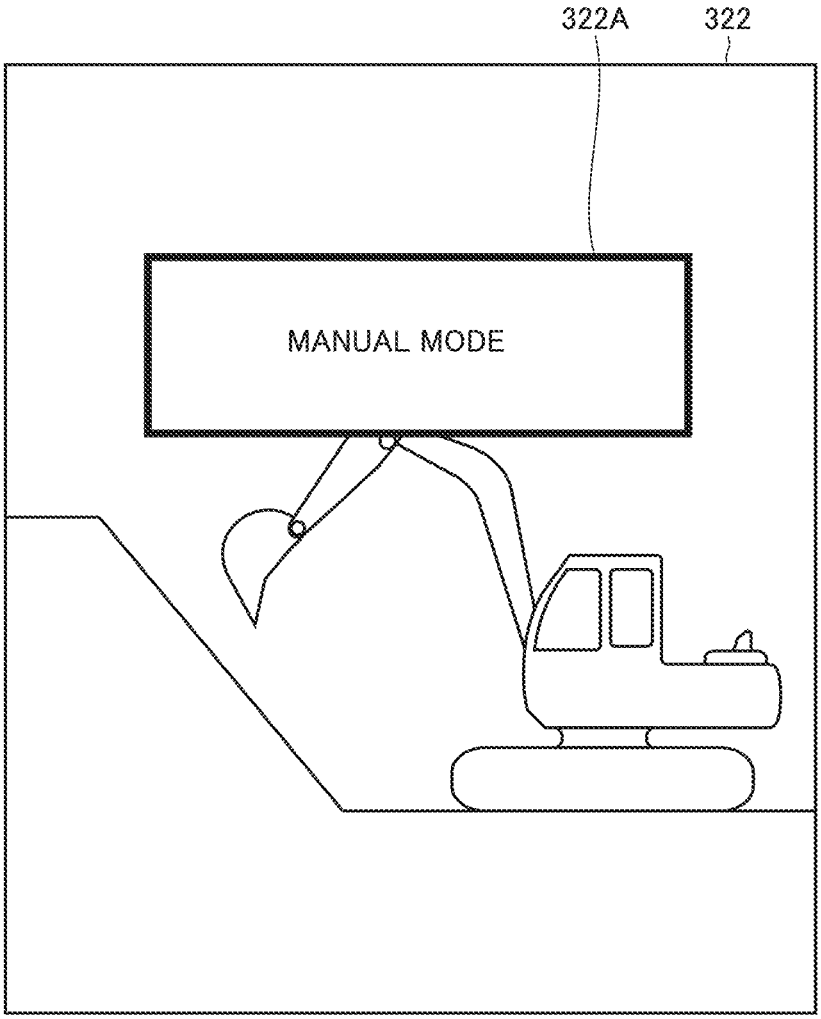
FIG. 6 is a schematic diagram of the display that provides notification representation involved with cancellation of automatic control.

FIG. 5 is a schematic diagram showing an exemplary image shown on display 322. Display 322 shown in FIG. 5 shows hydraulic excavator 100 and the slope which is the object to be worked by work implement 2. FIG. 6 is a schematic diagram of display 322 that provides notification representation 322A involved with cancellation of automatic control. Display 322 shown in FIG. 6 provides notification representation 322A as being superimposed on the representation shown in FIG. 5. The operator can recognize cancellation of automatic control of operations by work implement 2 by visually recognizing notification representation 322A provided on display 322.

Display 322 performs a function as a notification unit that notifies the operator of cancellation of automatic control of work implement 2 by controller 26 when controller 26 does so.

The notification unit that notifies the operator of cancellation of automatic control of work implement 2 is not limited to notification representation 322A on display 322 shown in FIG. 6. Hydraulic excavator 100 may include another apparatus to visually notify the operator of cancellation of automatic control, such as an indicator, for example, in cab 4. Hydraulic excavator 100 may include as the notification unit, an auralizing apparatus to notify the operator of cancellation of automatic control through voice and sound, such as a buzzer or a speaker, for example, in cab 4.

Then, the process ends (end).

When automatic control of work implement 2 is determined as being inactive in determination in step S1 (NO in step S1), the process ends as it is without cancellation of automatic control (end). When duration T2 during which traveling of traveling unit 5 has suspended is determined as being equal to or longer than the threshold value in determination in step S9 (YES in step S9), traveling unit 5 is determined as having stopped and the process ends without cancellation of automatic control (end).

Figure 7:
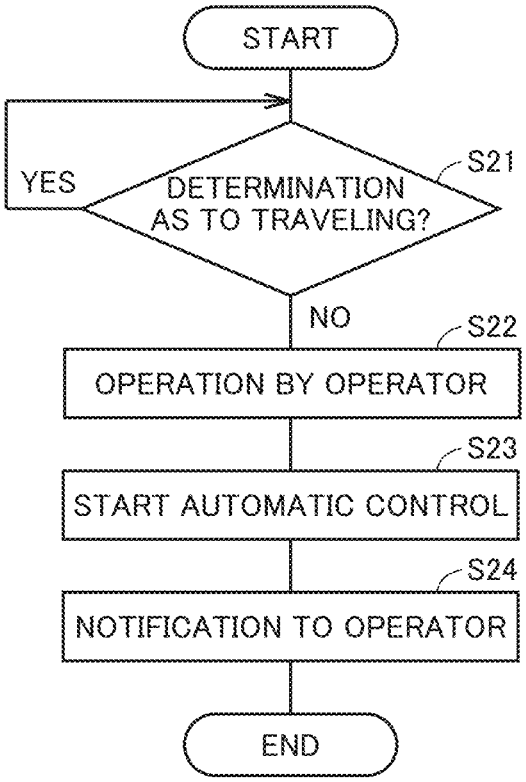
FIG. 7 is a flowchart showing processing for resuming automatic control.

Control for resuming automatic control of operations by work implement 2 after the processing for canceling automatic control of operations by work implement 2 described with reference to FIG. 4 will now be described. FIG. 7 is a flowchart showing processing for resuming automatic control.

As shown in FIG. 7, in step S21, determination as to traveling is made. Determination as to traveling is made as in determination in step S3 described above. When traveling unit 5 is determined as being in the traveling state in determination in step S21 (YES in step S21), determination in step S21 is repeated. Even when traveling unit 5 is determined as not being in the traveling state in determination in step S21 (NO in step S21), automatic control of operations by work implement 2 is not started at that time point.

Then in step S22, an operation by the operator is performed. The operator operates input portion 321 of man machine interface portion 32 shown in FIG. 2 to set automatic control of operations by work implement 2. In succession in step S23, controller 26 that has received an output from man machine interface portion 32 activates automatic control of operations by work implement 2.

Even though the traveling state is off in step S21, automatic control of operations by work implement 2 is not automatically activated but automatic control of operations by work implement 2 is activated only after acceptance of the operation by the operator in step S22.

In succession in step S24, the operator is notified of start of automatic control of operations by work implement 2.

Figure 8:
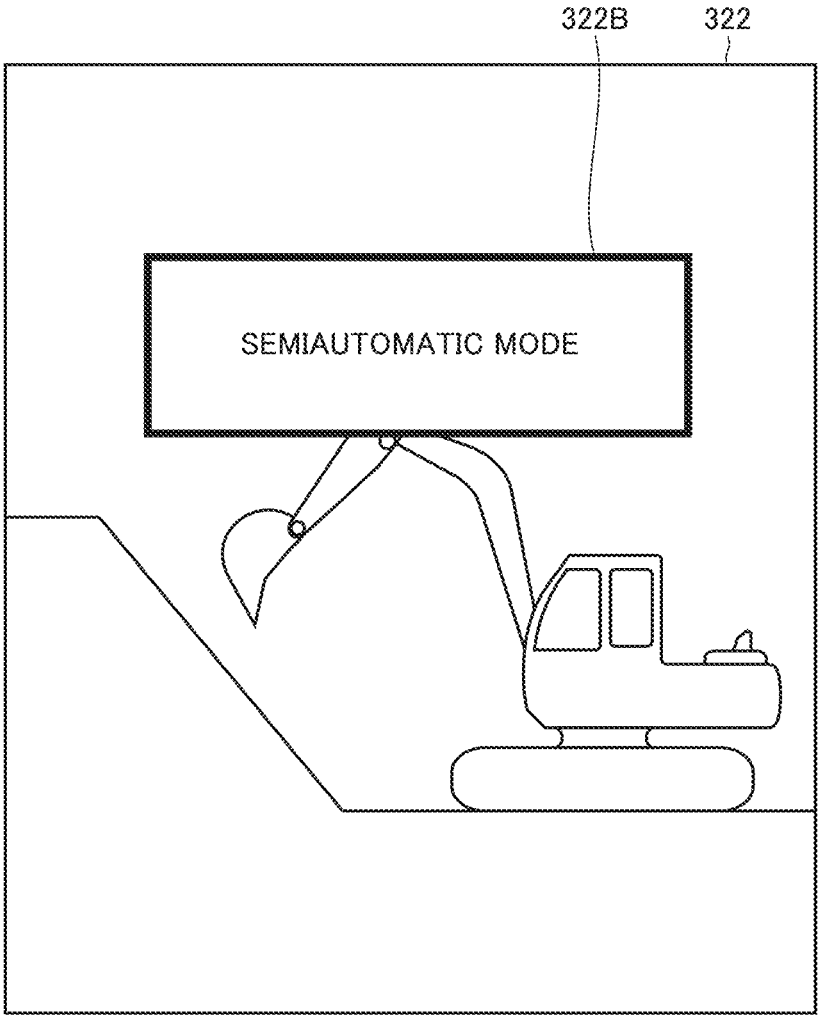
FIG. 8 is a schematic diagram of the display that provides notification representation involved with resumption of automatic control.

FIG. 8 is a schematic diagram of display 322 that provides notification representation 322B involved with resumption of automatic control. Display 322 shown in FIG. 8 provides notification representation 322B as being superimposed on the representation shown in FIG. 5. The operator can recognize resumption of automatic control of operations by work implement 2 by visually recognizing notification representation 322B provided on display 322.

Then, the process ends (end).

Characteristic features and functions and effects of the work machine according to the embodiment described above are summarized as below. Features in the embodiment have references allotted by way of example.

As shown in FIG. 2, hydraulic excavator 100 includes controller 26. Controller 26 automatically controls operations by work implement 2. As shown in FIG. 4, controller 26 cancels automatic control of operations by work implement 2 based on the traveling state of traveling unit 5. Specifically, controller 26 cancels automatic control of operations by work implement 2 on condition that traveling of traveling unit 5 has continued for a prescribed time period.

Controller 26 determines, based on an operation condition of traveling unit 5, that an active state of automatic control of operations by work implement 2 does not have to be maintained, and automatically cancels automatic control of work implement 2. The operator can freely operate work implement 2 during traveling without performing an operation to manually cancel automatic control of work implement 2. Therefore, hydraulic excavator 100 with the features in the embodiment achieves saving of works by the operator while traveling unit 5 travels.

As shown in FIG. 4, controller 26 determines that traveling is continuing when a duration of suspension of traveling of traveling unit 5 is shorter than a threshold value. The travel control lever may temporarily return to the neutral position, for example, in change in direction during traveling. Even when such suspension of travel for a short period of time is detected, it is determined that traveling has not actually suspended but is continuing. Thus, continuation of traveling of traveling unit 5 for a prescribed time period can more accurately be detected.

As shown in FIG. 6, notification representation 322A is provided on display 322 so that the operator is notified of cancellation of automatic control of work implement 2. The operator can recognize cancellation of automatic control by visually recognizing notification representation 322A on display 322.

Second Embodiment

Figure 9:
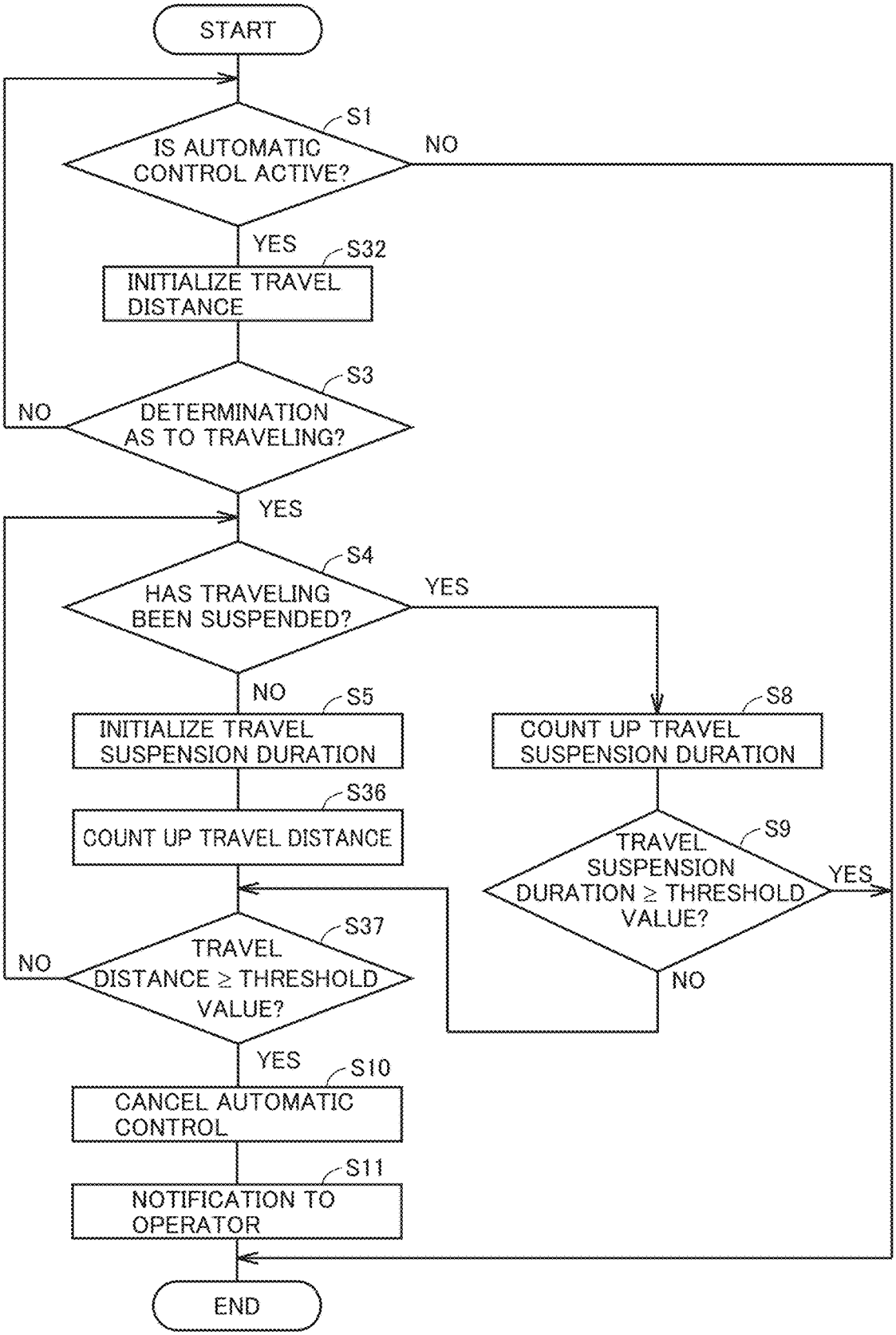
FIG. 9 is a flowchart showing processing for canceling automatic control based on a second embodiment.

FIG. 9 is a flowchart showing processing for canceling automatic control based on a second embodiment. Processing for canceling automatic control of work implement 2 in the second embodiment shown in FIG. 9 is different from that in the first embodiment described with reference to FIG. 4 in using a travel distance instead of a duration of traveling in determination as to the traveling state of traveling unit 5.

Specifically, after determination as to whether automatic control is active in step S1, the travel distance is initialized in step S32. Controller 26 sets a distance TD of continuous travel of traveling unit 5. Controller 26 sets TD=0 at a time point when it performs processing in step S32.

Controller 26 may detect a current position of hydraulic excavator 100 and set TD=0 at this current position. The current position of hydraulic excavator 100 can be found, for example, by detecting a position of installation of antenna 21 at the current time point on the global coordinate system. Alternatively, the current position of hydraulic excavator 100 may be found, for example, by measuring a distance from a prescribed reference position at a work site. Alternatively, the current position of hydraulic excavator 100 may be found, for example, by analyzing an image obtained by image pick-up of hydraulic excavator 100 by a camera. The camera may be arranged at a prescribed point at the work site or mounted on a drone. The current position of hydraulic excavator 100 may be found based on a position of hydraulic excavator 100 relative to design topography D.

Alternatively, controller 26 may calculate a traveling speed of traveling unit 5 based on an output from IMU 24 shown in FIG. 2, read current time from timer 262, and calculate a travel distance of traveling unit 5 by multiplying the speed by a time period.

After processing for initializing the travel suspension duration in step S5, in step S36, the travel distance is counted up. Controller 26 may detect the current position at the time point when it performs processing in step S36, add a distance from the position where TD=0 was set in step S32 to travel distance TD, and update travel distance TD. Alternatively, controller 26 may read current time from timer 262, calculate a distance by multiplying a time period from the time at which TD=0 was set in step S32 until the time read from timer 262 by the traveling speed of traveling unit 5, add the calculated distance to travel distance TD, and update travel distance TD.

In succession in step S37, whether or not travel distance TD is equal to or longer than a threshold value is determined. Controller 26 reads from memory 261, the threshold value for the distance of continuous travel of traveling unit 5. Controller 26 compares travel distance TD updated in step S36 with the threshold value for the distance and determines whether or not travel distance TD is equal to or longer than the threshold value. Controller 26 determines whether or not traveling unit 5 has continuously traveled the prescribed distance.

The threshold value for the distance of continuous travel of traveling unit 5 may be set, for example, to ten meters or longer or preferably fifty meters or longer.

When the continuous travel distance of traveling unit 5 is determined as being shorter than the threshold value in determination in step S37 (NO in step S37), the process returns to step S4 and whether or not travel of traveling unit 5 has suspended is determined again. When the continuous travel distance of traveling unit 5 is determined as being equal to or longer than the threshold value in determination in step S37 (YES in step S37), the process proceeds to step S10 and controller 26 cancels automatic control of work implement 2.

Third Embodiment

Figure 10:
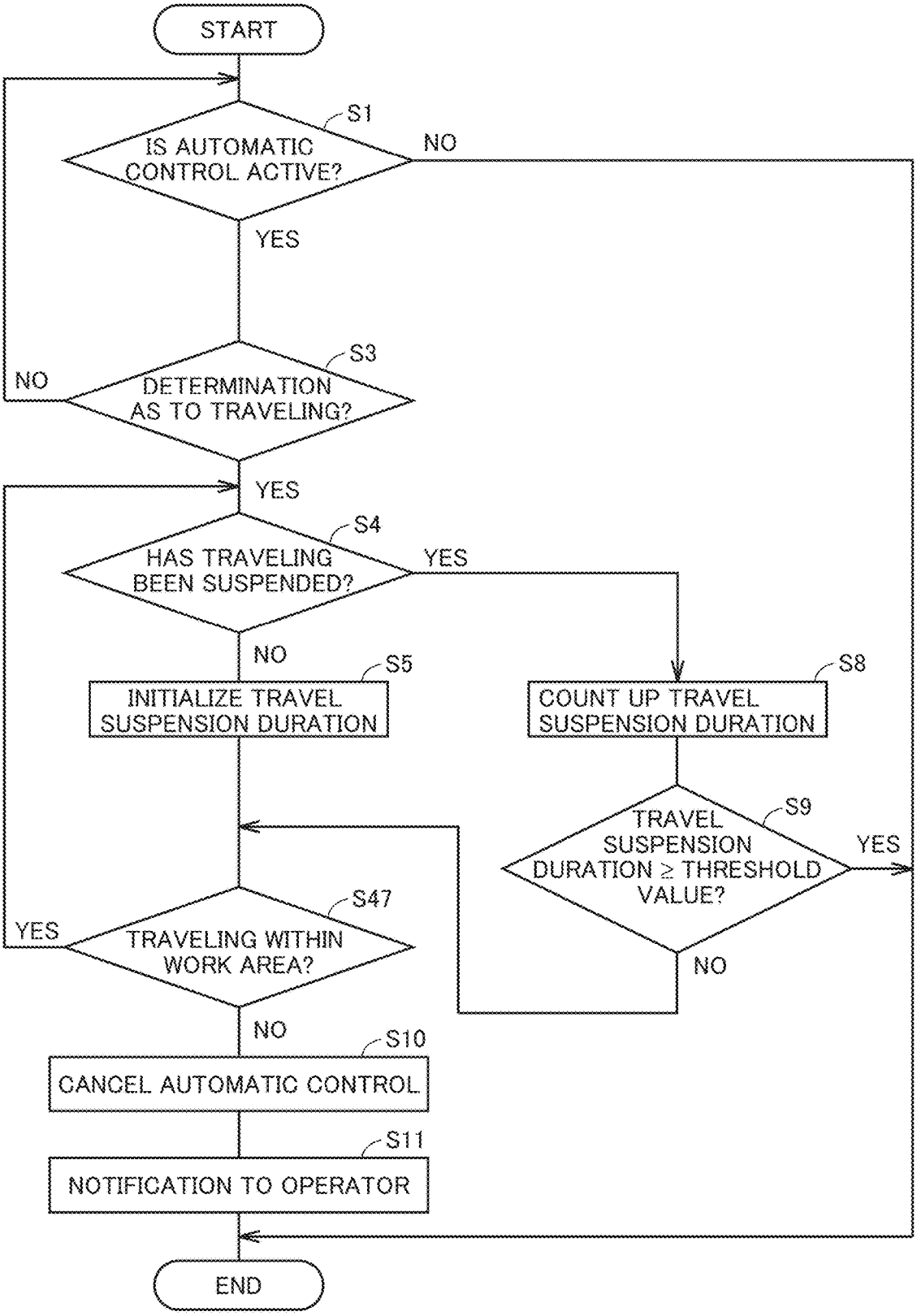
FIG. 10 is a flowchart showing processing for cancelling automatic control based on a third embodiment.

FIG. 10 is a flowchart showing processing for cancelling automatic control based on a third embodiment. Processing for canceling automatic control of work implement 2 in the third embodiment shown in FIG. 10 is different from that in the first and second embodiments in using a location where traveling unit 5 travels in determination as to the traveling state of traveling unit 5.

Specifically, the duration of traveling is not used, and therefore processing for initializing the duration of traveling in step S2 and processing for counting up the duration of traveling in step S6 shown in FIG. 4 do not have to be performed. Since the travel distance is not used, processing for initialing the travel distance in step S32 and processing for counting up the travel distance in step S36 shown in FIG. 9 do not have to be performed.

Therefore, when automatic control of operations by work implement 2 is determined as being active in determination in step S1, determination in step S3 is successively made. When traveling of traveling unit 5 is determined as not having suspended in determination in step S4, the process proceeds to step S47 and whether or not traveling unit 5 is traveling within a work area is determined. Controller 26 compares the work area recorded in memory 261 with the current position of hydraulic excavator 100 and determines where hydraulic excavator 100 in the traveling state is traveling.

When traveling unit 5 is determined as being traveling within the work area in determination in step S47 (YES in step S47), the process returns to step S4 and whether or not traveling of traveling unit 5 has suspended is determined again. When traveling unit 5 is determined as being traveling outside the work area in determination in step S47 (NO in step S47), the process proceeds to step S10 and controller 26 cancels automatic control of work implement 2.

In the description of the embodiments, an example in which hydraulic excavator 100 includes controller 26 and controller 26 mounted on hydraulic excavator 100 cancels automatic control of operations by work implement 2 is described. The controller that cancels automatic control of operations by work implement 2 does not necessarily have to be mounted on hydraulic excavator 100.

Figure 11:
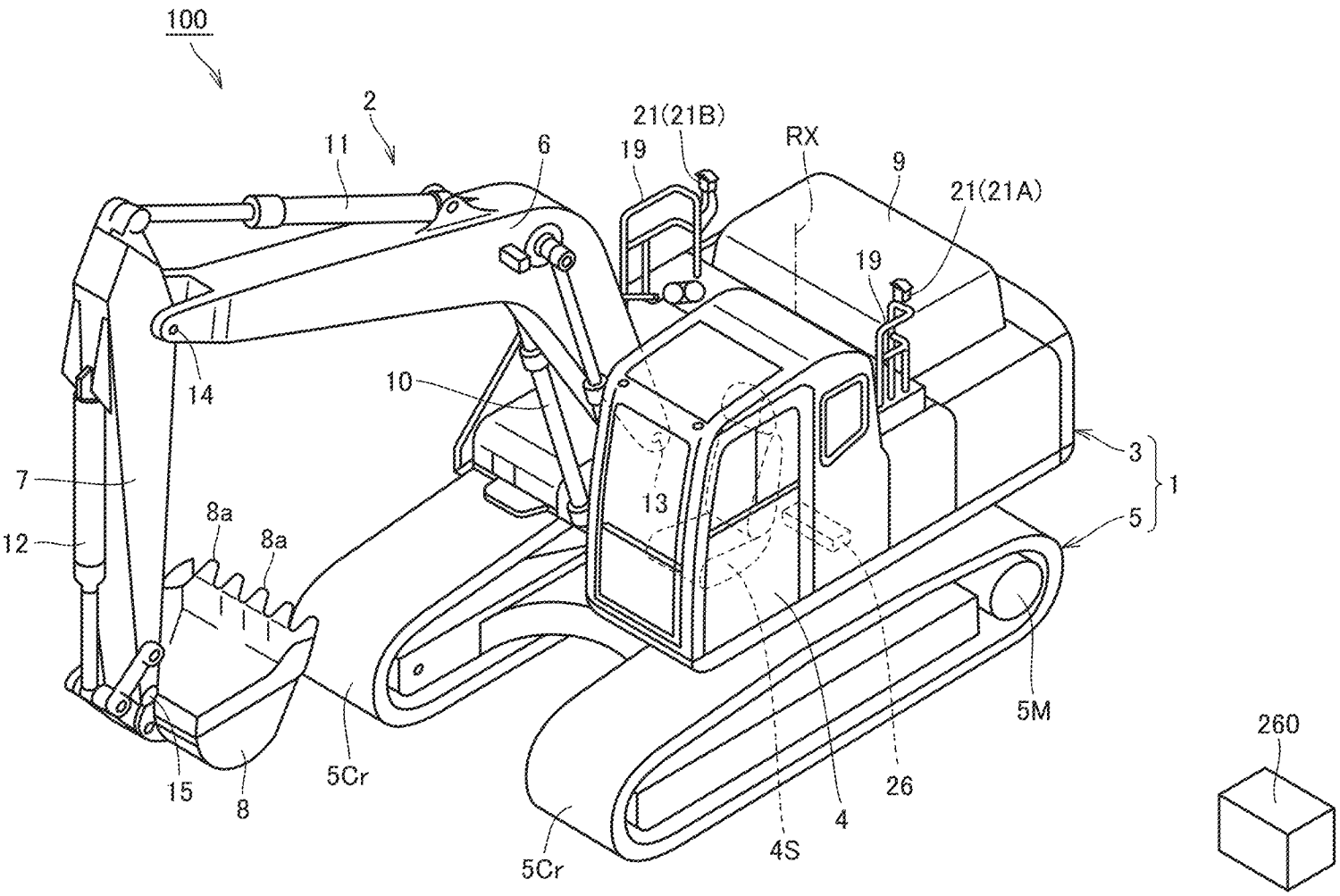
FIG. 11 is a schematic diagram of a system including the hydraulic excavator.

FIG. 11 is a schematic diagram of a system including hydraulic excavator 100. An external controller 260 provided separately from controller 26 mounted on hydraulic excavator 100 may configure a system for controlling cancellation of automatic control of operations by work implement 2. Controller 260 may be arranged at the work site of hydraulic excavator 100 or a remote location distant from the work site of hydraulic excavator 100.

It should be understood that the embodiments disclosed herein are illustrative and non-restrictive in every respect. The scope of the present invention is defined by the terms of the claims rather than the description above and is intended to include any modifications within the scope and meaning equivalent to the terms of the claims.

REFERENCE SIGNS LIST 1 main body; 2 work implement; 3 revolving unit; 4 cab; 4S operator's seat; 5 traveling unit; 5C*r* crawler belt; 5M travel motor; 6 boom; 7 arm; 8 bucket; 8*a* cutting edge; 10 boom cylinder; 11 arm cylinder; 12 bucket cylinder; 21 antenna; 21A first antenna; 21B second antenna; 23 global coordinate operation portion; 25 operation apparatus; 26, 260 controller; 27 control valve; 31 engine; 32 man machine interface portion; 33 hydraulic pump; 60 hydraulic actuator; 64 direction control valve; 65 spool stroke sensor; 66, 67 pressure sensor; 100 hydraulic excavator; 200 control system; 251 first travel control lever; 252 second travel control lever; 253 work implement lever; 261 memory; 262 timer; 321 input portion; 322 display; 322A, 322B notification representation; 450 pilot oil path; C current topography; D design topography; RX axis of revolution; T1, T2 duration; TD travel distance

The invention claimed is:

1. A work machine comprising:
a vehicular main body including a traveling unit;
a work implement attached to the vehicular main body; and
a controller that automatically controls operations by the work implement, wherein
the controller:
cancels automatic control of operations by the work implement based on one or more of i) determining that traveling of the traveling unit has continued for a prescribed time period, ii) determining that the traveling unit has continuously traveled a prescribed distance, and iii) determining that the traveling unit has traveled an area outside of a prescribed work area.

2. The work machine according to claim 1, wherein
the automatic control refers to control of operations by the work implement for design topography that represents a target shape of an object to be worked by the work implement.

3. The work machine according to claim 1, further comprising a notification unit that gives a notification about cancellation of the automatic control when the controller cancels the automatic control.

4. The work machine according to claim 1, wherein
the controller determines that traveling of the traveling unit is continuing when traveling of the traveling unit is suspended and a duration of suspension of traveling is shorter than a threshold value.

5. A system comprising:
a work machine including a vehicular main body including a traveling unit and a work implement attached to the vehicular main body; and
a controller that automatically controls operations by the work implement, wherein
the controller:
cancels automatic control of operations by the work implement based on one or more of i) determining that traveling of the traveling unit has continued for a prescribed time period, ii) determining that the traveling unit has continuously traveled a prescribed distance, and iii) determining that the traveling unit has traveled an area outside of a prescribed work area.

6. A method of controlling a work machine including a vehicular main body including a traveling unit and a work implement attached to the vehicular main body, the method comprising:
determining a traveling state of the traveling unit; and
canceling automatic control of operations by the work implement based on the traveling state of the traveling unit, the traveling stating of the traveling unit including one or more of i) determining that traveling of the traveling unit has continued for a prescribed time period, ii) determining that the traveling unit has continuously traveled a prescribed distance, and iii) determining that the traveling unit has traveled an area outside of a prescribed work area.

* * * * *